US009306687B2

(12) United States Patent
Jurascheck et al.

(10) Patent No.: US 9,306,687 B2
(45) Date of Patent: Apr. 5, 2016

(54) METHOD AND SYSTEM FOR OBTAINING MUSIC TRACK INFORMATION

(71) Applicant: Imagination Technologies Limited, Kings Langley (GB)

(72) Inventors: Nicholas H. Jurascheck, Bushey (GB); Ian Robert Knowles, Buckinghamshire (GB)

(73) Assignee: Imagination Technologies Limited, Kings Langley (GB)

( * ) Notice: Subject to any disclaimer, the term of this patent is extended or adjusted under 35 U.S.C. 154(b) by 190 days.

(21) Appl. No.: 14/039,328

(22) Filed: Sep. 27, 2013

(65) Prior Publication Data

US 2014/0106663 A1 Apr. 17, 2014

(30) Foreign Application Priority Data

Oct. 11, 2012 (GB) ..... 1218284.6

(51) Int. Cl.
*H04H 60/37* (2008.01)
*H04H 60/58* (2008.01)
*H04H 60/64* (2008.01)

(52) U.S. Cl.
CPC ..... *H04H 60/37* (2013.01); *H04H 60/58* (2013.01); *H04H 60/64* (2013.01)

(58) Field of Classification Search
None
See application file for complete search history.

(56) References Cited

U.S. PATENT DOCUMENTS

| | | | | |
|---|---|---|---|---|
| 7,565,104 | B1 | 7/2009 | Brown et al. | |
| 8,712,776 | B2 * | 4/2014 | Bellegarda | G10L 13/08 704/258 |
| 8,892,446 | B2 * | 11/2014 | Cheyer | G06F 17/3087 704/246 |
| 9,106,803 | B2 * | 8/2015 | Cazanas | H04N 7/17327 |
| 9,130,686 | B2 * | 9/2015 | Bolton | H04H 60/73 |
| 2008/0188209 | A1 * | 8/2008 | Dorogusker | G06Q 30/0241 455/414.2 |

FOREIGN PATENT DOCUMENTS

WO WO 2008/042953 A1 4/2008

OTHER PUBLICATIONS

Extended European Search Report in EP Application No. 13184631.3, Feb. 28, 2014.

* cited by examiner

*Primary Examiner* — Bobbak Safaipour
(74) *Attorney, Agent, or Firm* — Vorys, Sater, Seymour and Pease LLP; Vincent M DeLuca

(57) ABSTRACT

Methods and systems according to the disclosure are for obtaining information for a music track on a radio broadcast and may include storing track information received from an information service in a data storage module. When an intermediary server receives a request from an end-user device for information for a particular music track playing on a particular radio broadcast signal, the server first checks the data storage module to determine if it has music track information for the particular music track. If so, the server provides that music track information to the end-user device. The intermediary server may be configured to automatically and preemptively request information from the music information service each time a new music track is played on a radio broadcast signal. The intermediary server may be configured to request information from the music information service the first time it receives a request for that particular music track.

19 Claims, 5 Drawing Sheets

METHOD AND SYSTEM FOR OBTAINING MUSIC TRACK INFORMATION

BACKGROUND

In current systems, when a radio listener indicates that they wish to obtain information about the music track (e.g. music track title and artist) that is currently playing on the radio, the radio captures a predetermined amount of audio (e.g. 10 seconds) from the music track and generates an audio fingerprint. The audio fingerprint is typically smaller than a 10 second audio sample of the music track thus reducing the amount of data that needs to be sent.

Once created, the radio sends the audio fingerprint to a music information service, such as Shazam™.

The music information service attempts to identify the music track using the audio fingerprint. For example, Shazam™ maintains a library of audio fingerprints and when Shazam™ receives an audio fingerprint it searches for a match in the library.

If the music information service is able to identify the music track using the fingerprint then information about the music track is provided to the radio. The radio may then display the information to the user and/or present the user with options for purchasing the identified music track. For example, the radio may send the information about the track to a server which provides the radio with a music library ID which can be used to purchase the music track. If the music information service is unable to identify the music track using the fingerprint then the music information service may return an error to the radio.

Each identification request costs money, takes time to complete and uses up valuable bandwidth.

The embodiments described below are not limited to implementations which solve any or all of the disadvantages of known systems.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Described herein are methods and systems for obtaining music track information for a music track playing on a radio broadcast signal. The method comprises storing music track information received from a music information service in a data storage module. When an intermediary server receives a request from an end-user device for music track information for a particular music track playing on a particular radio broadcast signal, the intermediary server first checks the data storage module to determine if it already has music track information for the particular music track. If it does, the intermediary server provides the music track information from the data storage module to the end-user device. In some cases, the intermediary server may be configured to automatically and preemptively request information from the music information service each time a new music track is played on a radio broadcast signal. In other cases, the intermediary server may be configured to request information from the music information service the first time it receives a request for that particular music track.

A first aspect provides a method to obtain music track information, the method comprising: storing music track information received from a music information service in a data storage module; receiving a request at an intermediary server from an end-user device for music track information for a particular music track playing on a particular radio broadcast signal; determining at the intermediary server if the data storage module comprises music track information for the particular music track by checking a flag associated with the particular radio broadcast signal; if the data storage module comprises music track information for the particular music track, transmitting the music track information for the particular music track from the intermediary server to the end-user device; if the data storage module does not comprise music track information for the particular music track, transmitting a request to the music information service for music track information for the particular music track; in response to receiving, at the intermediary server, a reply from the music information service comprising music track information for the music track identified in the request, storing the music track information in the data storage module and setting the flag associated with the particular radio broadcast signal at the intermediary server to indicate that the data storage module comprises music track information for the music track currently playing on the particular radio broadcast signal; determining whether the particular music track has ended; and if the particular music track has ended, setting the flag associated with the particular radio broadcast signal to indicate that the data storage module does not comprise music track information for the music track currently playing on the particular radio broadcast signal.

A second aspect provides a system to obtain music track information, the system comprising: a data storage module configured to store music track information received from a music information service; and an intermediary server in communication with the data storage module, the intermediary server configured to: receive a request from an end-user device for music track information for a particular music track playing on a particular radio broadcast signal; determine if the data storage module comprises music track information for the particular music track by checking a flag associated with the particular radio broadcast signal; if the data storage module comprises music track information for the particular music track, transmit the music track information for the particular music track to the end-user device if the data storage module does not comprise music track information for the particular music track, transmit a request to the music information service for music track information for the particular music track; in response to receiving a reply from the music information service comprising music track information for the music track identified in the request, store the music track information in the reply in the data storage module and set the flag associated with the particular radio broadcast signal to indicate that the data storage module comprises music track information for the music track currently playing on the particular radio broadcast signal; and determine whether the particular music track for the particular radio broadcast signal has ended and if the particular music track has ended, set the flag associated with the particular radio broadcast signal to indicate that the data storage module does not comprise music track information for the music track currently playing on the particular radio broadcast signal.

The methods described herein may be performed by a computer configured with software in machine readable form stored on a tangible storage medium e.g. in the form of a computer program comprising computer program code for configuring a computer to perform all the steps of any of the methods described. Examples of tangible (or non-transitory) storage media include disks, thumb drives, memory cards etc. and do not include propagated signals. The software can be suitable for execution on a parallel processor or a serial processor such that the method steps may be carried out in any suitable order, or simultaneously.

This acknowledges that firmware and software can be valuable, separately tradable commodities. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

Figure 1:
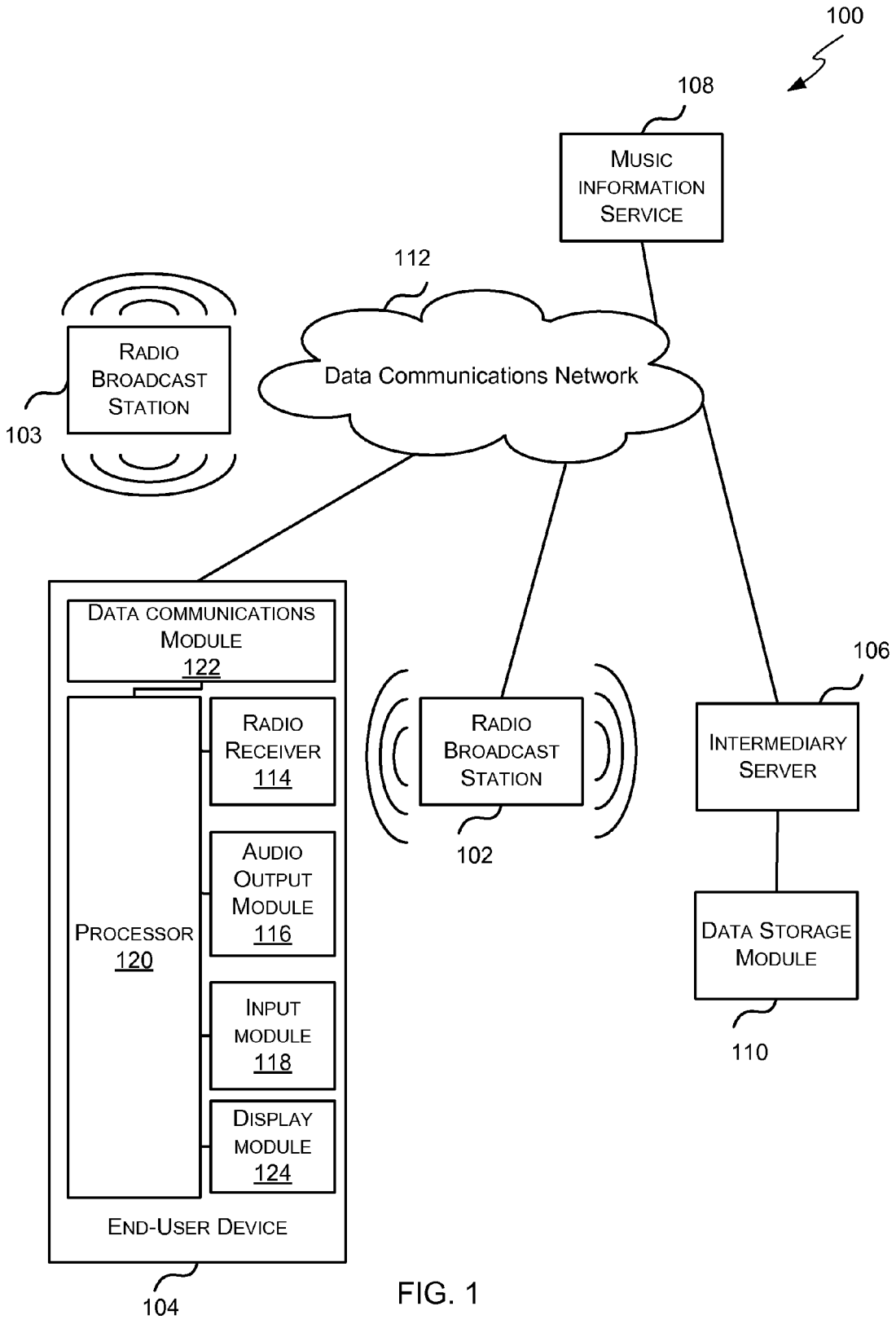
FIG. 1 is a block diagram of a system for obtaining music track information.

Common reference numerals are used throughout the figures to indicate similar features.

DETAILED DESCRIPTION

Embodiments of the present invention are described below by way of example only. These examples represent the best ways of putting the invention into practice that are currently known to the Applicant although they are not the only ways in which this could be achieved. The description sets forth the functions of the example and the sequence of steps for constructing and operating the example. However, the same or equivalent functions and sequences may be accomplished by different examples.

Embodiments described herein relate to methods and systems for obtaining music track information in a more efficient manner. Specifically, instead of transmitting a request to the music information service each time a request is received from an end-user device, the system is configured to store music track information received from the music information service and before sending a new request to the music information service the system first checks the stored music track information to determine if the system already has music track information for the music track. In some cases, the system may be configured to automatically and preemptively request music track information from the music information service each time a new music track is played on a radio broadcast signal. In other cases, the system may be configured to request music track information from the music information service the first time it receives a request for that particular music track.

Typically each information request sent to the music information service costs money and consumes bandwidth and time, even if the same user requests music track information for the same music track multiple times or if the music information service is unable to identify the music track using the identifying information (e.g. audio fingerprint) provided. Accordingly money, bandwidth and time may be saved in the methods and systems described herein since requests are only sent when required. Specifically, in the methods and systems described herein a music track information request is only sent to the music information service if the system does not already have information that may satisfy the request.

Reference is now made to FIG. 1 which illustrates a system 100 for obtaining music track information. The system 100 comprises one or more radio broadcast stations 102 and 103 for generating a radio broadcast signal; an end-user device 104 for allowing a user to listen to the radio broadcast signal and to specify that that they wish to receive music track information for a particular music track playing on a radio broadcast signal; an intermediary server 106 for handling music track information requests from the end-user device 104; a music information service 108 for providing music track information; a data storage module 110 for storing music track information; and a data communications network 112 for enabling at least the end-user device 104, intermediary server 106 and music information service 108 to communicate. In some cases the data communications network 112 may also enable one or more radio broadcast stations (e.g. radio broadcast station 102) to communicate with the end-user device 104 and/or intermediary server 106.

The radio broadcast stations 102 and 103 generate and broadcast one or more radio broadcast signals comprising audio that may be received by a radio receiver. At least a portion of each radio broadcast signal comprises music tracks. The term "music track" is used herein to mean a discrete instance of music which may or may not include singing, such as a song, a piece of music, or a portion thereof. The radio broadcast signals may also comprise other non-music related components such as news components, talk radio components and any other suitable components.

The radio broadcast stations 102 and 103 may be configured to broadcast the radio broadcast signal(s) over radio waves using known techniques such as, but not limited to, Amplitude Modulation (AM), Frequency Modulation (FM), Digital Audio Broadcasting (DAB) and/or HD Radio™. One or more of the radio broadcast stations (e.g. radio broadcast station 102) may alternatively, or in addition, be configured to broadcast or stream the radio broadcast signal(s) over a data communications network, such as data communications network 112. Although the system 100 is shown as comprising two radio broadcast stations 102 and 103, it will be evident to a person of skill in the art that the principles described herein may be equally applied to systems comprising more or fewer radio broadcast stations.

The end-user device 104 is a computer-based device that allows a user to listen to one or more radio broadcast signals and request music track information for a music track the user is currently listening to.

The end-user device 104 may comprise a radio receiver 114, an audio output module 116, an input module 118, a processor 120, and a data communication module 122.

The radio receiver 114 is configured to receive radio broadcast signals broadcast by radio broadcast stations, such as radio broadcast stations 102 and 103. The radio receiver 114 may be able to receive AM, FM, DAB and/or HD Radio™ radio broadcast signals. Alternatively, or in addition, the radio receiver 114 may be able to receive radio broadcast signals from a data communications network, such as data communications network 112.

Upon receiving a radio broadcast signal, the radio receiver 114 provides the audio of the radio broadcast signal to the audio output module 116. The audio output module 116 then outputs the audio in a manner so that the user can hear the audio. The audio output module 116 may, for example, be a speaker, headphones or any other suitable device that allows a user to hear audio.

While the user is listening to the audio via the audio output module 116, the user may want to learn about a particular music track that is currently playing. For example, the user may want to know the title and/or artist of the current music track. The user may request such information via an input module 118. The input module 118 may be, for example, but is not limited to: a button, a keyboard, a mouse, or a touch screen. In response to receiving such a request from the user via the input module 118, the input module 118 forwards the request to the processor 120.

The processor 120 receives the request from the input module 118 and generates a formal request which may include information identifying the radio broadcast signal that the user is currently listening to. The processor 120 then provides the formal request to the data communications module 122. The data communications module 122 then transmits the formal request to the intermediary server 106 via the data communications network 112. The data communications module 122 may support one or more wireless data communication technologies (e.g. Wi-Fi, cellular, satellite) and/or wired data communication technologies (e.g. Ethernet, Token Ring).

The end-user device 104 then waits to receive music track information in response to the request. If the end-user device 104 receives music track information from the intermediary server 106 it may display it to the user via a display module 124.

The end-user device 104 may be, for example, but is not limited to: a stand-alone radio, a stand-alone audio system incorporating radio functionality, a car-based radio, a personal computer, a tablet computer, or a smart phone.

Although the system 100 of FIG. 1 shows a single end-user device 104, it will be evident to a person of skill in the art that the principles described herein may be equally applied to a system with a plurality of end-user devices. Where there are a plurality of end-user devices the music track information stored in the data storage module 110 is shared between all of the end-user devices, rather than being stored on a per end-user device basis.

The intermediary server 106 is a computer-based device or set of devices that acts as an intermediary between the end-user device(s) 104 and the music information service 108. Specifically, in the system 100 of FIG. 1, the intermediary server 106 is configured to receive music track information requests from end-user devices 104, request music track information from the music information service 108, and provide the music track information received from the music information service 108 to the end-user devices 104.

Therefore, in contrast to known systems, instead of the end-user devices transmitting requests directly to the music information service 108, the end-user devices submit requests to the intermediary server 106. Furthermore, to save bandwidth and time, the intermediary server 106 does not send a request to the music information service 108 each time a request is received from an end-user device 104, but instead the intermediary server 106 stores music track information received from the music information service 108 in the data storage module 110 and before sending a new request to the music information service 108 the system first checks the music track information stored in the data storage module 110 to determine if the intermediary server 106 already has valid information for the music track.

In some cases, the intermediary server 106 may be configured to automatically and preemptively request information from the music information service 108 each time a new music track is played on a radio broadcast signal. For example, the intermediary server 106 may monitor one or more radio broadcast signals and each time it detects that a new music track is being played on a radio broadcast signal it may transmit a request to the music information service 108 for music track information for the new music track. The request comprises identifying information for the music track that is used by the music information service 108 to identify the music track. In some cases the identifying information is an audio fingerprint for the music track which is generated from a sample of a predetermined length (e.g. 10 seconds) of the music track. The music track information received from the music information service 108 in response to the request is then stored in the data storage module 110. Then, when the intermediary server 106 receives a subsequent request from an end-user device 104 it may use the music track information stored in the data storage module 110 to satisfy the request. Exemplary methods for obtaining music track information and processing music track information requests in accordance with this case are described in reference to FIGS. 2 and 3.

In other cases, the intermediary server 106 may be configured to request information from the music information service 108 only upon receiving an initial request from any end-user device 104 for a particular music track. For example, the intermediary server 106 may listen for music track information requests from end-user devices 104. Upon receiving a request from an end-user device 104, the intermediary server 106 may determine if the data storage module 110 already comprises information for the identified music track. Determining if the data storage module 110 already comprises information for the identified music track may comprise identifying the radio broadcast signal that the request relates to and determining if the data storage module 110 already comprises music track information for the music track currently playing on the relevant radio broadcast signal.

If the data storage module 110 already comprises music track information for the identified music track, then the intermediary server 106 obtains the relevant music track information from the data storage module 110 and provides it to the end-user device 104.

If the data storage module 110 does not comprise information for the identified music track, the intermediary server 106 may transmit a request to the music information service 108 for music track information for the identified music track. As described above, the request comprises identifying information (e.g. an audio fingerprint) for the music track that is used by the music information service 108 to identify the music track. The music track information received from the music information service 108 in response to the request is then provided to the end-user device 104. For example, the music track information may be transmitted to the end-user device 104 via the data communications network 112. The music track information received from the music information service 108 is also stored in the data storage module 110. Then, when the intermediary server 106 receives a subsequent request from an end-user device 104 for the same music track it may use the music track information stored in the data storage module 110 to satisfy the request.

Figure 4:
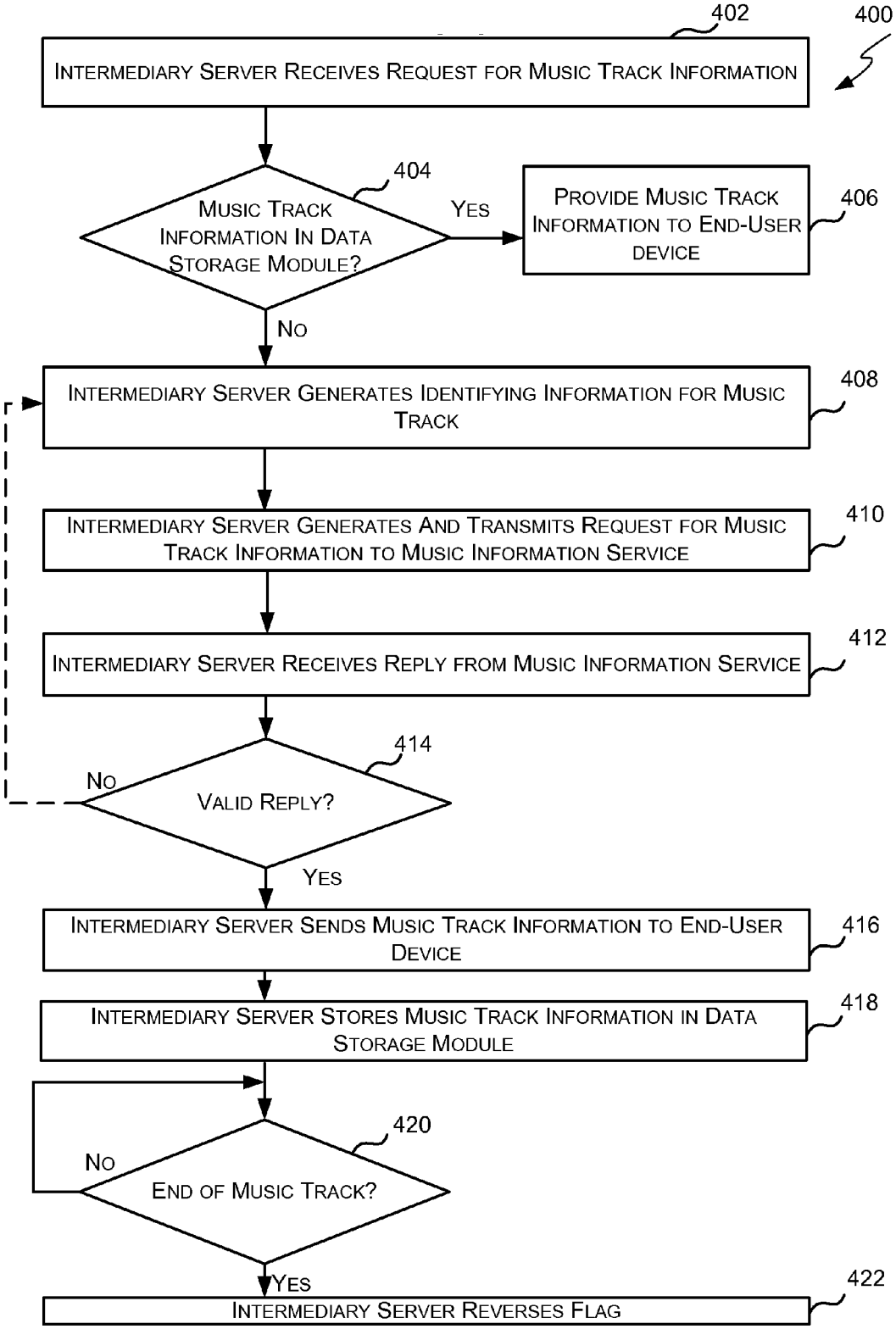
FIG. 4 is a flowchart of a second exemplary method for processing music track information requests using the system of FIG. 1.

An exemplary method for processing music track information requests in accordance with this case is described in reference to FIG. 4.

The music information service 108 is a computer-based device or set of devices that provides music track information in response to requests from the intermediary server 106 for music track information for a particular music track. Specifically, the music information service 108 stores identifying information for a plurality of music tracks along with information about each of the tracks. The information that the music information service 108 provides for a particular music track is referred to herein as "music track information". The music track information may comprise, but is not limited to, the title of the music track, the artist of the music track and the duration of the music track.

The music information service 108 uses the identifying information in the request to identify the music track. For example, where the identifying information is an audio fingerprint, the music information service 108 may compare the audio fingerprint in the request to the stored audio fingerprints to find a match. If the music information service 108 is able to identify the track using the identifying information provided then the music information service 108 transmits the corresponding music track information to the intermediary server 106. The music information service 108 may be operated by a third party such as Shazam™.

The data storage module 110 is configured to store the music track information received from the music information service 108. The data storage module 110 may be implemented as any device suitable for storing electronic data. For example, the data storage module 110 may be implemented in memory including volatile and non-volatile, removable and non-removable memory implemented in any method or technology for storage of information. Memory includes, but is not limited to, RAM, ROM, EPROM, EEPROM, flash memory or other memory technology that can be used to store information accessible by a computing device. In another example, the data storage module 110 may be implemented as a database.

In some cases the functions performed by the intermediary server 106 and the data storage module 110 may be performed by a single device. For example, the data storage module 110 may be implemented as a memory module within the intermediary server 106. In other cases, the functions performed by the intermediary server 106 and the data storage module 110 may be performed by separate devices. For example, the data storage module 110 may be implemented as a separate database server.

The data communications network 112 may be any network, or combination of networks, capable of enabling data communication between the other devices in the system 100. For example, the data communications network 112 may be a public switched telephone network (PSTN), a mobile telephone network, a wireless data network, a wired data network, or any combination thereof.

Figure 2:
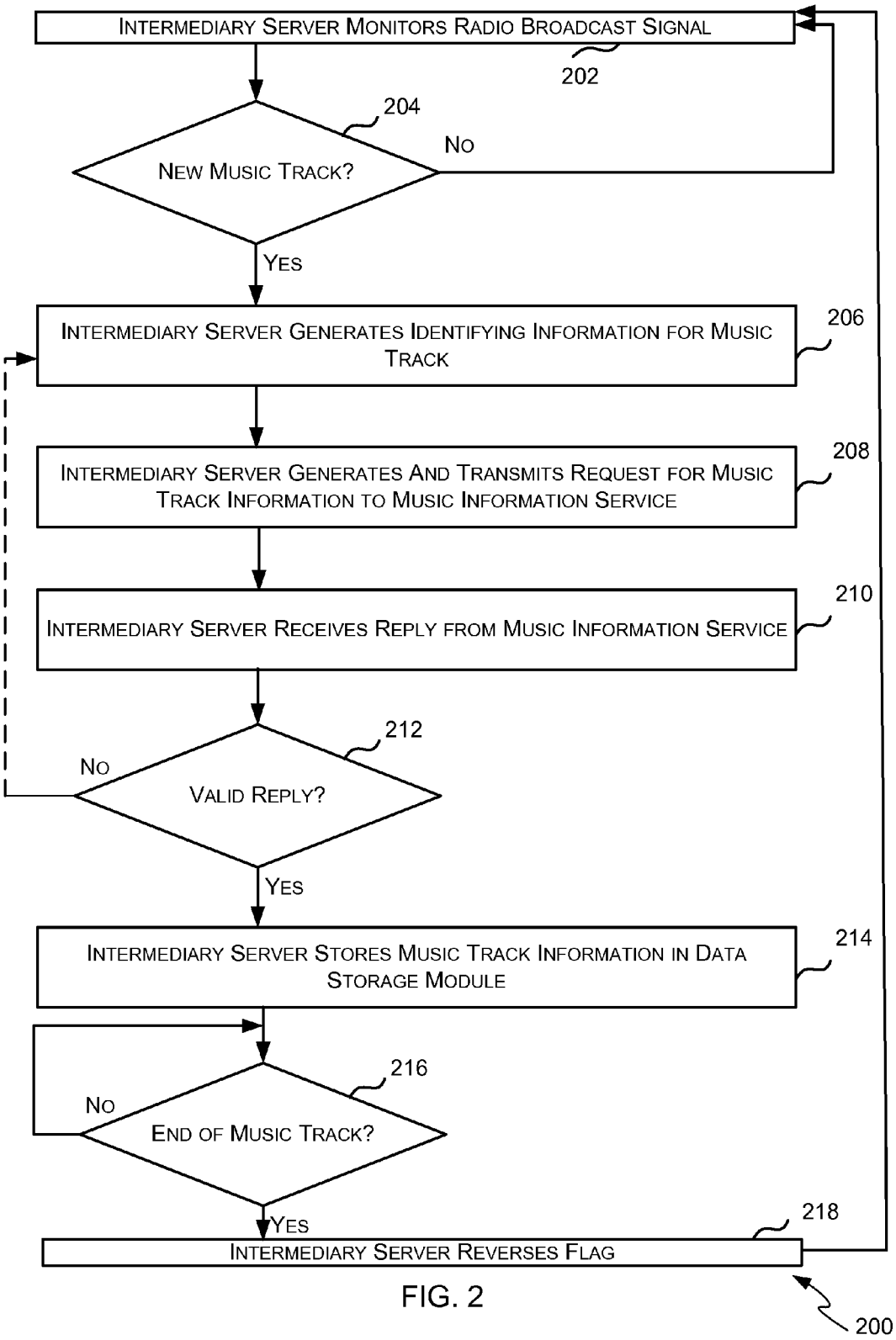
FIG. 2 is a flowchart of a method for obtaining music track information using the system of FIG. 1.

Reference is now made to FIG. 2 which illustrates a first exemplary method 200 for obtaining music track information using the system 100 of FIG. 1. In this method 200 the intermediary server 106 preemptively obtains music track information from the music information service 108 for each new music track played on a radio broadcast signal. The intermediary server 106 then stores the information received from the music information service 108 in a data storage module 110 so that any requests for music track information from an end-user device 104 may be satisfied using the information stored in the data storage module 110.

At step 202 of the method 200, the intermediary server 106 monitors a radio broadcast signal. In some cases, monitoring a radio broadcast signal may comprises tuning an AM, FM or DAB radio receiver to the appropriate channel to receive the radio broadcast signal via radio waves. In other cases, monitoring a radio broadcast signal may comprise obtaining a digital stream of the radio broadcast signal from the appropriate radio broadcast station 102 via the data communications network 112.

At step 204 the intermediary server 106 determines whether a new music track is being played on the radio broadcast signal. In some cases the intermediary server 106 may determine that a new music track is being played on the radio broadcast signal using information embedded within the radio broadcast signal itself. For example, some radio broadcast stations embed metadata within the radio broadcast signal. As is known to those of skill in the art, metadata is data providing information about one or more aspects of the related data (e.g. audio signal). The metadata may include information that explicitly identifies the start and end of music tracks.

Where, however, the metadata does not include explicit information that identifies the start and end of music tracks, the metadata may include information identifying the name and/or artist of the music track that is currently playing. In these cases the intermediary server 106 may monitor the metadata to identify when the artist and/or title information has changed. When the artist and/or title information has changed, the intermediary server 106 may determine that a new music track is being played. Although in this case the metadata may comprise similar information to the music track information, the metadata information is not typically as accurate as the music track information (e.g. making it difficult to access/purchase the correct version of the music track), nor does it comprise all of the information in the music track information.

In other cases the intermediary server 106 may determine that a new music track is being played on the radio broadcast signal by continuously monitoring the structure of the audio being played and looking for changes in the structure of the audio (e.g. tempo, tone etc.). In these cases, the intermediary server 106 may determine that a new music track is being played on the radio broadcast signal when the structure of the audio significantly changes.

If the intermediary server 106 determines that a new music track is being played on the radio broadcast signal, the method 200 proceeds to step 206. If, however, the intermediary server 106 determines that a new music track is not being played on the radio broadcast signal, the method 200 returns to step 202.

At step 206, the intermediary server 106 generates identifying information for the music track currently playing on the radio broadcast signal. In some cases generating the identifying information may comprise obtaining a sample of a predetermined length (e.g. 10 seconds) of the music track currently playing and generating an audio fingerprint of the music track from the sample. Once the identifying information is generated the method 200 proceeds to step 208.

At step 208, the intermediary server 106 generates a request for music track information and transmits it to the music information service 108. The request comprises the identifying information (e.g. audio fingerprint) generated in step 206. In some cases the request is transmitted from the intermediary server 106 to the music information service 108 via a data communications network, such as data communications network 112. Once the request (including the identifying information) has been transmitted to the music information service 108, the method 200 proceeds to step 210

At step 210, the intermediary server 106 receives a reply from the music information service 108 in response to the request made in step 208. Once the reply has been received from the music information service 108, the method 200 proceeds to step 212.

At step 212, the intermediary server 106 determines whether the reply is a valid reply. A valid reply is one that includes music track information for the particular music track. A valid reply may be received when the music information service 108 is able to identify the music track from the identifying information (e.g. audio fingerprint) provided. A non-valid reply is one that does not include music track information for the particular music track. A non-valid reply may be received when the music information service 108 is unable to identify the music track from the identifying information (e.g. audio fingerprint) provided. The music information service 108 may be unable to identify the music track from the identifying information because the identifying information (e.g. audio fingerprint) does not comprise audio or sufficient audio (e.g. the audio sample comprises mainly DJ chat); or because the music information service 108 does not contain identifying information and music track information for the particular music track in its database.

If the intermediary server 106 determines that the reply is a valid reply then the method 200 proceeds to step 214. If, however, the intermediary server 106 determines that the reply is not valid then the method 200 may end, or the method 200 may proceed to step 206 where the intermediary server 106 attempts to obtain new identifying information for the music track. In some cases the intermediary server 106 will only attempt to obtain new identifying information for the music track if the intermediary server 106 determines that the music track is still playing and there is a minimum amount of time left (e.g. 10 seconds) in the music track to generate valid identifying information (e.g. audio fingerprint).

At step 214, the intermediary server 106 stores the music track information from the reply in the data storage module 110. In some cases the intermediary server 106 may also set a flag to a positive value to indicate that data storage module 110 has music track information for the music track currently playing. The flag may be represented using any suitable data structure. For example, the flag may be represented by a binary value that may be set to a "1" to indicate a positive or true value (e.g. that the data storage module 110 has music track information for the current music track) or "0" to indicate a negative or false value (e.g. that the data storage module 110 does not have music track information for the current music track). In another example, the flag may be represented by a Boolean value that may be set to "TRUE" to indicate a positive or true value (e.g. that the data storage module 110 has music track information for the current music track) or "FALSE" to indicate a negative or false value (e.g. that the data storage module 110 does not have music track information for the current music track). Where the intermediary server 106 monitors more than one radio broadcast signal, there may be one flag for each radio broadcast signal being monitored. Once the music track information has been stored and the flag set, the method 200 proceeds to step 216.

At step 216, the intermediary server 106 determines whether the music track has ended. The intermediary server 106 may use any suitable method to determine when a music track has ended. For example, in some cases the intermediary server 106 may use any of the methods described in reference to step 204 of method 200 for detecting the start of a music track. In particular, the intermediary server 106 may determine that a music track has ended using information embedded within the radio broadcast signal itself (e.g. metadata identifying start/stop, other metadata (e.g. name and/or artist)), or by monitoring the structure of the audio of the radio broadcast signal.

In other cases, the intermediary server 106 may be configured determine the end of a music track using information obtained from the music information service 108. For example, if the music information service 108 is able to identify the music track using the identifying information provided (e.g. audio fingerprint) it usually provides information about the identified music track. The information provided by the music information service 108 typically comprises at least the artist of the track and the name of the track, but it also may comprise other information such as the duration of the track and how much time has elapsed between the beginning of the track and the time the identifying information (e.g. audio fingerprint) was generated. The intermediary server 106 may be configured to use the duration and elapsed time data to determine when a particular music track will end. For example, if the duration is 3 minutes and the elapsed time is 2 minutes, the intermediary server 106 may determine that the music track will end in 1 minute (e.g. 3 minutes−2 minutes=1 minute).

Since radio broadcast stations do not typically play music tracks back to back continuously without interruption (e.g. it is very common for there to be non-music between tracks such as advertisements, DJ talk and/or news etc.) and not all radio broadcasts play all of a music track (e.g. they may cut off a portion of the music track so that it fits into their schedule), the technique of using the information obtained from the music information service 108 to determine the end of a music track may be combined with other techniques, such as those described in reference to step 204 of method 200, to improve its accuracy.

If the intermediary server 106 determines that the music track has ended then the method 200 proceeds to step 218. If, however, the intermediary server 106 determines that the music track has not ended, then the method 200 repeats step 216.

At step 218, the intermediary server 106 reverses the flag set in step 214 to indicate that the data storage module 110 does not comprise music track information for the music track currently playing. Where, for example, the flag is a one bit value, reversing the flag may comprise changing the flag from a "1" value to a "0" value. Where, for example, the flag is a Boolean value, reversing the flag may comprising changing the flag from "TRUE" to "FALSE". Once the flag has been reversed, the method 200 proceeds back to step 202.

It will be evident to a person of skill in the art that although method 200 is described in reference to monitoring a single radio broadcast signal, the method may equally be applied to a plurality of radio broadcasts signals which may be monitored in parallel, in which case a flag is maintained for each radio broadcast signal.

Figure 3:
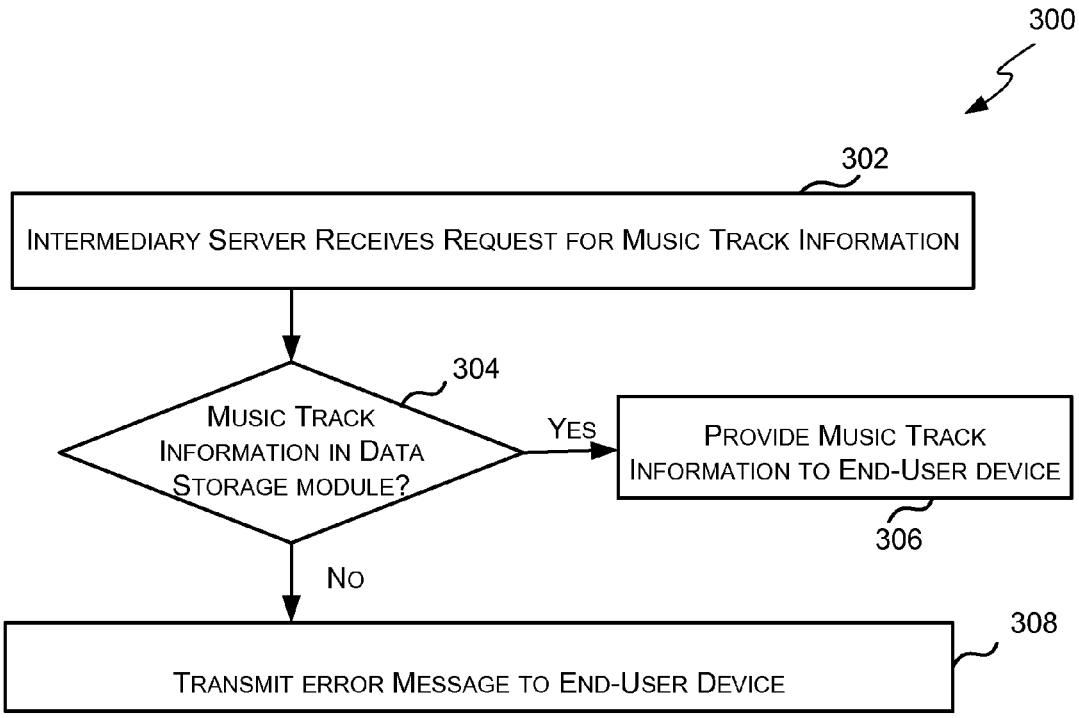
FIG. 3 is a flowchart of a first exemplary method for processing music track information requests using the system of FIG. 1.

Reference is now made to FIG. 3, which illustrates a first exemplary method 300 for processing requests for music track information from end-user devices 104. In this method 300 (which is typically used in conjunction with the music track information obtaining method 200 of FIG. 2) the intermediary server 106 has preemptively requested the music track information for each new music track played on the radio broadcast signal. Accordingly, when the intermediary server 106 receives a request from an end-user device 104 it obtains the information stored in the data storage module 110 for the music track currently playing and then provides this to the end-user device 104.

At step 302, the intermediary server 106 receives a request from an end-user device 104 for music track information for a particular music track for a particular radio broadcast signal. In some cases, the particular music track is the music track currently playing on the identified radio broadcast signal. Once the intermediary server 106 has received the request, the method 300 proceeds to step 304.

At step 304, the intermediary server 106 determines whether the data storage module 110 comprises music track information for the particular music track. In some cases, determining whether the data storage module 110 has music track information for the particular music track may comprise checking a flag value to determine if it has been set to a true or positive value. For example, as described above in reference to step 214, in some cases once the intermediary server 106 has obtained music track information for the music track that is currently playing on a particular radio broadcast signal, the intermediary server 106 may set a flag value associated with the particular radio broadcast signal to a positive or true value.

If the intermediary server 106 determines that the data storage module 110 comprises music track information for the particular music track, the method 300 proceeds to step 306. If, however, the intermediary server 106 determines that the data storage module 110 does not comprise music information for the particular music track, the method 300 proceeds to step 308.

At step 306, the intermediary server 106 obtains the music track information for the particular music track from the data storage module 110 and transmits it to the end-user device 104. The intermediary server 106 may transmit the information to the end-user device 104 using any suitable means. For example, the intermediary server 106 may transmit the music track information to the end-user device 104 using a data communications network, such as data communications network 112. In some cases the intermediary server 106 may also be configured to transmit data to the end-user device 104 that enables the user to easily access and/or purchase an official recording of the music track. For example, the data may comprise a link to a website or the like that allows the user to access and/or purchase an official recording of the music track. Providing the user access to the music track may allow the user to play the music track again. Once the information has been transmitted the method 300 ends.

At step 308, the intermediary server 308 transmits an error message to the end-user device 104 notifying the end-user that the intermediary server 106 was unable to obtain the requested information. Upon receiving the error message, the end-user device 104 may be configured to display the error message to the user. Upon seeing the message the user may decide to submit another request or abandon the request. Once the error message has been transmitted, the method 300 may end.

In cases where the intermediary server 106 is configured to preemptively obtain music track information from the intermediary server 106 for each new music track that is played on a radio broadcast signal, the intermediary server 106 may be able to provide users with a list of music tracks that were played on the radio broadcast signal over a predetermined period of time. For example, the user may recall that they liked a song that was played on a particular radio broadcast signal on their drive home from work (e.g. between 5:30 pm and 6:00 pm). The user, via the end-user device 104 or another device, may send a request to the intermediary server 106 for the music track information for that radio broadcast signal for that time period (e.g. 5:30 pm to 6:00 pm). The intermediary server 106 may then search the data storage module 110 for music track information for the specified period for the specified radio broadcast signal and provide this to the user. The information provided to the user may comprise the music track information for each music track played during the specified period; and/or the start and/or end times the music track was played on the radio broadcast signal.

Such a feature may be particularly useful for a user who wishes to obtain music track information for a particular music track that is playing on a radio broadcast station, but is unable to interact with the end-user device 104 (e.g. they are driving or otherwise occupied) to issue a music track information request. This feature (if the user is able to remember roughly when the song was played) would allow them to request the music track information at a later time by specifying the particular radio broadcast signal and the time.

Reference is now made to FIG. 4 which illustrates a second exemplary method 400 for processing requests for music track information. In this method, instead of preemptively obtaining music track information for each new music track played on a radio broadcast signal, the intermediary server 106 obtains music track information from the music information service 108 only after receiving a first request from any end-user device 104 for the music track information for a particular music track. The music track information received from the music information service 108 is then stored in the data storage module 110 so that any subsequent request for information for the same music track may then be satisfied using the music track information stored in the data storage module 110.

At step 402 the intermediary server 106 receives a request from an end-user device 104 for a particular music track on a particular radio broadcast signal. In some cases, the particular music track is the music track currently playing on the identified radio broadcast signal. Once the intermediary server 106 has received the request, the method 400 proceeds to step 404.

At step 404, the intermediary server 106 determines whether the data storage module 110 comprises music track information for the particular music track. In some cases, determining whether the data storage module 110 comprises music track information for the particular music track may comprise checking a flag to determine if it has been set to a true or positive value. For example, once the intermediary server 106 has obtained music track information for the music track currently playing on a particular radio broadcast signal, the intermediary server 106 may set a flag value associated with the particular radio broadcast signal to a positive or true value. The flag may be represented using any suitable data structure. For example, the flag may be represented by a binary value or a Boolean value.

In other cases, determining whether the data storage module 110 comprises music track information for the particular music track may comprise comparing at least a portion of the current metadata for the identified radio broadcast signal to the information stored in the data storage module 110 for the identified radio broadcast signal to determine whether they relate to the same music track. For example, the intermediary server 106 may compare the title and/or artist information in the metadata to the information stored in the data storage module 110 for the identified radio broadcast signal. If the name and/or artist in the metadata match the name and/or artist in the data storage module 110, then it may be determined that the data storage module 110 has music track information for the particular music track. Although in this case the metadata may comprise similar information to the music track information it may still be beneficial to obtain music track information from the music information service 108 since music track information obtained from a music information service 108 is typically more accurate and more comprehensive than the metadata information.

If the intermediary server 106 determines that the data storage module 110 comprises music track information for the particular music track, the method 400 proceeds to step 406. If, however, the intermediary server 106 determines data storage module 110 does not comprise music track information for the particular music track, the method 400 proceeds to step 408.

At step 406, the intermediary server 106 obtains the music track information for the particular music track from the data storage module 110 and transmits it to the end-user device 104. The intermediary server 106 may transmit the music track information to the end-user device 104 using any suitable means. For example, the intermediary server 106 may transmit the music track information to the end-user device 104 using a data communications network, such as data communications network 112. In some cases, the intermediary server 106 may also be configured to transmit data to the end-user device 104 that enables the user to easily access and/or purchase an official recording of the music track. For example, the data may comprise a link to a website or the like that allows the user to access and/or purchase an official recording of the music track. Once the information has been transmitted the method 400 ends.

At step 408, the intermediary server 106 generates identifying information for the particular music track. In some cases, generating the identifying information comprises obtaining a sample of a predetermined length (e.g. 10 seconds) of the music track currently playing and generating an audio fingerprint using the sample. Once the identifying information is generated the method 400 proceeds to step 410. In some cases, the intermediary server 106 will only execute step 408 and any subsequent steps if the intermediary server 106 has determined that there is enough time left (e.g. more than 10 seconds) in the music track to generate valid identifying information (e.g. audio fingerprint). In these cases money, bandwidth and time may be saved by not generating and transmitting a music track information request to the music information service 108 when it is unlikely that the music information service 108 will be able to identify the music track using the identifying information.

At step 410, the intermediary server 106 generates a request for music track information and transmits it to the music information service 108. The request comprises the identifying information (e.g. audio fingerprint) generated in step 408. In some cases the request is transmitted from the intermediary server 106 to the music information service 108 via a data communications network, such as data communications network 112. Once the request (including the identifying information) has been transmitted to the music information service 108, the method 400 proceeds to step 412.

At step 412, the intermediary server 106 receives a reply from the music information service 108 in response to the request made in step 410. Once the reply has been received from the music information service 108, the method 400 proceeds to step 414.

At step 414, the intermediary server 106 determines whether the reply is a valid reply. A valid reply is one that includes music track information for the particular music track. A valid reply may be received when the music information service 108 is able to identify the music track from the identifying information (e.g. audio fingerprint) provided. A non-valid reply is one that does not include music track information for the particular music track. A non-valid reply may be received when the music information service 108 is unable to identify the music track from the identifying information (e.g. audio fingerprint) provided.

If the intermediary server 106 determines that the reply is a valid reply then the method 400 proceeds to step 416. If, however, the intermediary server 106 determines that the reply is not valid then the method 400 may end, or the method 400 may proceed back to step 408 where the intermediary server 106 attempts to obtain new identifying information for the particular music track. In some cases the intermediary server 106 will only attempt to obtain new identifying information for the music track if the intermediary server 106 determines that the music track is still playing and there is a minimum amount of time left (e.g. 10 seconds) in the music track to generate valid identifying information.

At step 416, the music track information in the reply is transmitted from the intermediary server 106 to the end-user device 104. The information may be transmitted to the end-user device 104 using any suitable means. For example, the intermediary server 106 may transmit the music track information for the identified music track to the end-user device 104 using a data communications network, such as data communications network 112. Once the music track information has been transmitted to the end-user device 104, the method proceeds to step 418.

At step 418, the intermediary server 106 stores the music track information from the reply in the data storage module 110. In some cases, the intermediary server 106 may also set the flag associated with the identified radio broadcast signal to a positive value to indicate that the data storage module 110 has valid information from the music information service 108 for the music track currently playing on the identified radio broadcast signal. Where, for example, the flag is a binary value, setting the flag to a positive value may comprise setting the flag to a "1" value. Where, for example, the flag is a Boolean value, setting the flag to a positive value may comprise setting the flag to a "TRUE" value. Once the information has been stored and the flag set (in cases where a flag is used), the method 400 proceeds to step 420.

At step 420, the intermediary server 106 determines whether the music track has ended. The intermediary server 106 may use any suitable method to determine when a music track has ended. For example, the intermediary server 106 may use any of the methods described in reference to step 204 of method 200. In particular, the intermediary server may determine that a music track has ended using information embedded within the radio signal itself (e.g. metadata identifying the start and stop of a track, other metadata (e.g. name and/or artist)), or by monitoring the structure of the audio. If the intermediary server 106 determines that the music track has ended then the method 400 proceeds to step 422. If, however, the intermediary server 106 determines that the music track has not ended, then the method repeats step 420.

At step 422, the intermediary server 106 reverses the flag set in step 418 to indicate that the data storage module 110 does not have music track information for the music track currently playing on the identified radio broadcast signal. Where, for example, the flag is a one bit value, reversing the flag may comprise changing the flag from a "1" value to a "0" value. Where, for example, the flag is a Boolean value, reversing the flag may comprising changing the flag from "TRUE" to "FALSE". Once the flag has been reversed, the method 400 ends.

It will be evident to a person of skill in the art that an intermediary server 106 may use a combination of the methods described in reference to FIGS. 2 to 4. For example, the intermediary server 106 may be configured to: (i) monitor certain radio broadcast signals (e.g. very popular radio broadcast signals) and preemptively request music track information from the music information service 108 for these radio broadcast signals; and (ii) reactively request music track information (e.g. only upon receiving a user request) from the music information service 108 for other radio broadcast signals (e.g. less popular radio broadcast signals).

Figure 5:
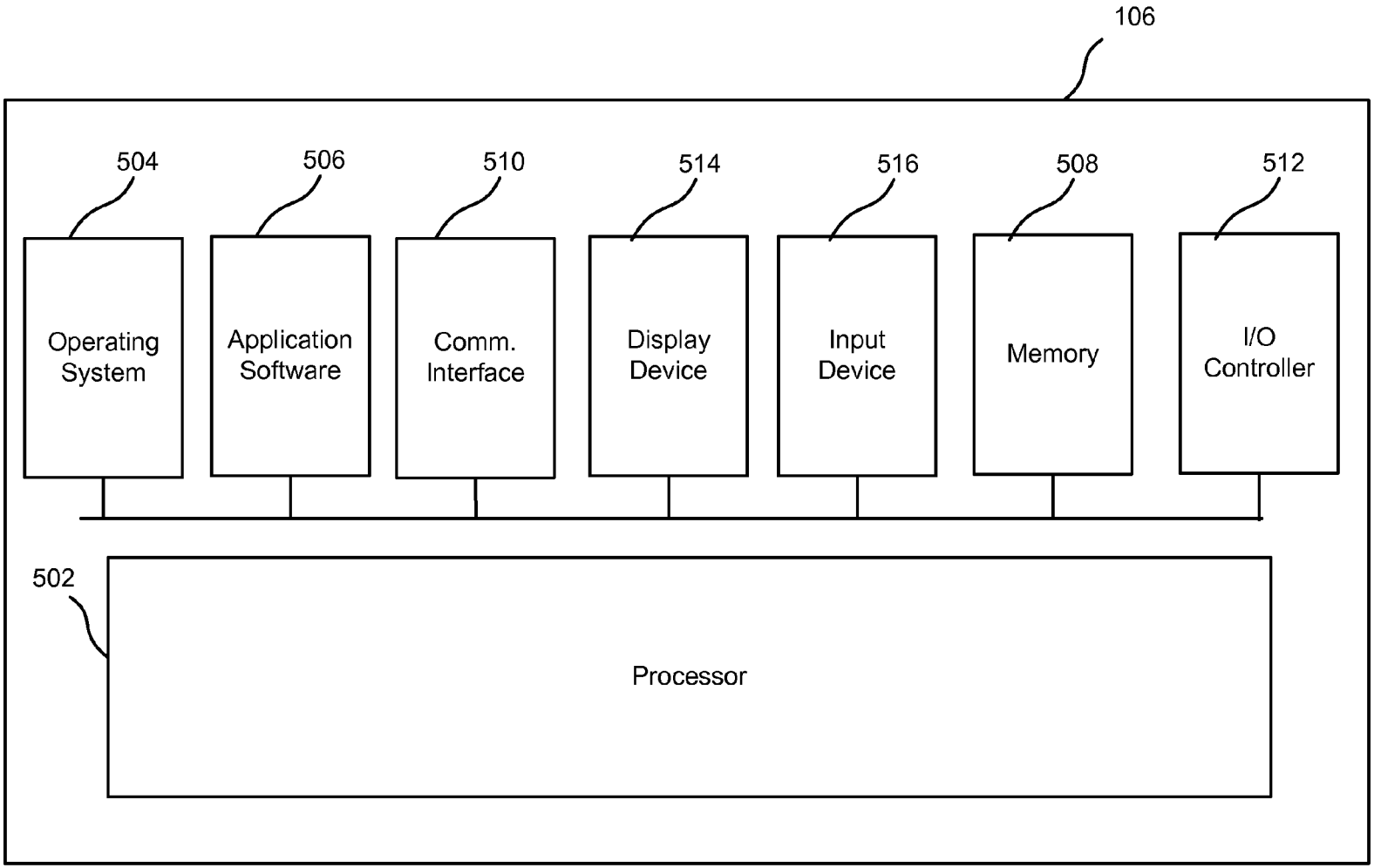
FIG. 5 is a block diagram of an exemplary intermediary server of FIG. 1.

Reference is now made to FIG. 5 which illustrates an exemplary intermediary server 106 which may be implemented as any form of a computing and/or electronic device, and in which embodiments of the foregoing description may be implemented.

The intermediary server 106 comprises one or more processors 502 which may be microprocessors, controllers or any other suitable type of processors for processing computer executable instructions to control the operation of the device in order to run applications. In some examples, for example where a system on a chip architecture is used, the processors 502 may include one or more fixed function blocks (also referred to as accelerators) which implement a part of the method of operation of the intermediary server 106 or applications described herein in hardware (rather than software or firmware). Platform software comprising an operating system 504 or any other suitable platform software may be provided at the intermediary server 106 to enable application software 506 to be executed on the device.

The computer executable instructions may be provided using any computer-readable media that is accessible by the intermediary server 106. Computer-readable media may include, for example, computer storage media and communications media. Computer storage media (i.e. non-transitory machine readable media), such as memory 508, includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Although the computer storage media (i.e. non-transitory machine readable media, e.g. memory 508) is shown within the intermediary server 106 it will be appreciated that the storage may be distributed or located remotely and accessed via a network or other communication link (e.g. using communication interface 510).

The intermediary server 106 also comprises an input/output controller 512 arranged to output display information to a display device 514 which may be separate from or integral to the intermediary server 106. The display information may provide a graphical user interface. The input/output controller 512 is also arranged to receive and process input from one or more devices, such as a user input device 516 (e.g. a mouse or a keyboard). In an embodiment the display device 514 may also act as the user input device 516 if it is a touch sensitive display device. The intermediary server 106 may also be provided with other functionality as is known for such devices. For example, the communication interface 510 may comprise a radio receiver for receiving AM, FM and/or DAB radio broadcast signals.

It is noted that the intermediary server 106 shown in FIG. 5 is an exemplary intermediary server 106 that may be used in the methods and systems described herein. It will be evident to a person of skill in the art that the methods and systems described herein may be implemented with an intermediary server with more or fewer components than the intermediary server shown in FIG. 5.

The term 'processor' and 'computer' are used herein to refer to any device with processing capability such that it can execute instructions. Those skilled in the art will realize that such processing capabilities are incorporated into many different devices and therefore the term 'computer' includes set top boxes, media players, digital radios, PCs, servers, mobile telephones, personal digital assistants and many other devices.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Memories storing machine executable data for use in implementing disclosed aspects can be non-transitory media. Non-transitory media can be volatile or non-volatile. Examples of volatile non-transitory media include semiconductor-based memory, such as SRAM or DRAM. Examples of technologies that can be used to implement non-volatile memory include optical and magnetic memory technologies, flash memory, phase change memory, resistive RAM.

A particular reference to "logic" refers to structure that performs a function or functions. An example of logic includes circuitry that is arranged to perform those function(s). For example, such circuitry may include transistors and/or other hardware elements available in a manufacturing process. Such transistors and/or other elements may be used to form circuitry or structures that implement and/or contain memory, such as registers, flip flops, or latches, logical operators, such as Boolean operations, mathematical operators, such as adders, multipliers, or shifters, and interconnect, by way of example. Such elements may be provided as custom circuits or standard cell libraries, macros, or at other levels of abstraction. Such elements may be interconnected in a specific arrangement. Logic may include circuitry that is fixed function and circuitry can be programmed to perform a function or functions; such programming may be provided from a firmware or software update or control mechanism. Logic identified to perform one function may also include logic that implements a constituent function or sub-process. In an example, hardware logic has circuitry that implements a fixed function operation, or operations, state machine or process.

Any range or device value given herein may be extended or altered without losing the effect sought, as will be apparent to the skilled person.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein to mean including the method blocks or elements identified, but that such blocks or elements do not comprise an exclusive list and a method or apparatus may contain additional blocks or elements. Furthermore, the blocks, elements and operations are themselves not impliedly closed.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought. Where elements of the figures are shown connected by arrows, it will be appreciated that these arrows show just one example flow of communications (including data and control messages) between elements. The flow between elements may be in either direction or in both directions.

It will be understood that the above description of a preferred embodiment is given by way of example only and that various modifications may be made by those skilled in the art. Although various embodiments have been described above with a certain degree of particularity, or with reference to one or more individual embodiments, those skilled in the art could make numerous alterations to the disclosed embodiments without departing from the spirit or scope of this invention.

The invention claimed is:

1. A method to obtain music track information, the method comprising:

storing music track information received from a music information service in a data storage module;

receiving a request at an intermediary server from an end-user device for music track information for a particular music track currently playing on a particular radio broadcast signal;

determining at the intermediary server if the data storage module comprises music track information for the particular music track by checking a flag associated with the particular radio broadcast signal;

in response to determining that the data storage module comprises music track information for the particular music track, transmitting the music track information for the particular music track from the intermediary server to the end-user device;

in response to determining that the data storage module does not comprise music track information for the particular music track, transmitting a request to the music information service for music track information for the particular music track;

in response to receiving, at the intermediary server, a reply from the music information service comprising music track information for the music track identified in the request, storing the music track information in the data storage module and setting the flag associated with the particular radio broadcast signal at the intermediary server to indicate that the data storage module comprises music track information for the music track currently playing on the particular radio broadcast signal;

determining whether the particular music track has ended; and in response to determining that the particular music track has ended, setting the flag associated with the particular radio broadcast signal to indicate that the data storage module does not comprise music track information for the music track currently playing on the particular radio broadcast signal.

2. The method according to claim 1, further comprising:

monitoring at the intermediary server the particular radio broadcast signal;

determining at the intermediary server whether a new music track is currently playing on the particular radio broadcast signal; and in response to determining that a new music track is currently playing on the particular radio broadcast signal, transmitting a request from the intermediary server to the music information service for music track information for the new music track currently playing.

3. The method according to claim 1, further comprising generating identifying information for the music track currently playing on the particular radio broadcast signal, wherein the request transmitted to the music information service comprises the identifying information.

4. The method according to claim 3, wherein generating the identifying information comprises sampling the music track currently playing on the particular radio broadcast signal for a predetermined period of time and generating an audio fingerprint based on the sample.

5. The method according to claim 2, wherein determining at the intermediary server whether a new music track is currently playing on the particular radio broadcast signal comprises monitoring metadata embedded in the particular radio broadcast signal.

6. The method according to claim 5, wherein the metadata comprises music track start and end data for each music track played on the particular radio broadcast signal.

7. The method according to claim 5, wherein the metadata comprises at least one of artist and title information for each music track played on the particular radio broadcast signal.

8. The method according to claim 2, wherein determining at the intermediary server whether a new music track is currently playing on the particular radio broadcast signal comprises monitoring the audio structure of the particular radio broadcast signal.

9. The method according to claim 1, wherein the music track information received from the music information service is stored in the data storage module prior to receiving the request at the intermediary server from the end-user device.

10. The method according to claim 1, further comprising, at the end-user device:

receiving input from a user indicating a request to obtain music track information for the particular music track playing on the particular radio broadcast signal;

transmitting the request from the end-user device to the intermediary server; and receiving music track information from the intermediary server in response to the request transmitted to the intermediary server.

11. A system to obtain music track information, the system comprising:

a data storage module configured to store music track information received from a music information service; and an intermediary server in communication with the data storage module, the intermediary server configured to:

receive a request from an end-user device for music track information for a particular music track currently playing on a particular radio broadcast signal;

determine if the data storage module comprises music track information for the particular music track by checking a flag associated with the particular radio broadcast signal;

in response to determining that the data storage module comprises music track information for the particular music track, transmit the music track information for the particular music track to the end-user device;

in response to determining that the data storage module does not comprise music track information for the particular music track, transmit a request to the music information service for music track information for the particular music track;

in response to receiving a reply from the music information service comprising music track information for the music track identified in the request, store the music track information in the reply in the data storage module and set the flag associated with the particular radio broadcast signal to indicate that the data storage module comprises music track information for the music track currently playing on the particular radio broadcast signal; and determine whether the particular music track for the particular radio broadcast signal has ended and if the particular music track has ended, set the flag associated with the particular radio broadcast signal to indicate that the data storage module does not comprise music track information for the music track currently playing on the particular radio broadcast signal.

12. The system according to claim 11, wherein the intermediary server is further configured to:

monitor the particular radio broadcast signal;

determine whether a new music track is currently playing on the particular radio broadcast signal; and in response to determining that a new music track is currently playing on the particular radio broadcast signal, transmit a request to the music information service for music track information for the new music track currently playing.

13. The system according to claim 11, wherein the intermediary server is further configured to generate identifying information for the music track currently playing on the particular radio broadcast signal, wherein the request transmitted to the music information service comprises the identifying information.

14. The system according to claim 13, wherein generating the identifying information comprises sampling the music track currently playing on the particular radio broadcast signal for a predetermined period of time and generating an audio fingerprint based on the sample.

15. The system according to claim 12, wherein determining whether a new music track is currently playing on the particular radio broadcast signal, comprises monitoring metadata embedded in the particular radio broadcast signal.

16. The system according to claim 15, wherein the metadata comprises music track start and end data for each music track played on the particular radio broadcast signal.

17. The system according to claim 15, wherein the metadata comprises at least one of artist and title information for each music track played on the particular radio broadcast signal.

18. The system according to claim 12, wherein determining whether a new music track is currently playing on the particular broadcast signal, comprises monitoring the audio structure of the particular radio broadcast signal.

19. The system according to claim 11, further comprising the end-user device configured to:

receive input from a user indicating a request to obtain music track information for the particular music track playing on the particular radio broadcast signal;

transmit the request from the end-user device to the intermediary server; and receive music track information from the intermediary server in response to the request transmitted to the intermediary server.

* * * * *